US009629230B1

(12) United States Patent
Douglas et al.

(10) Patent No.: US 9,629,230 B1
(45) Date of Patent: Apr. 18, 2017

(54) RF KICKER CAVITY TO INCREASE CONTROL IN COMMON TRANSPORT LINES

(71) Applicant: JEFFERSON SCIENCE ASSOCIATES, LLC, Newport News, VA (US)

(72) Inventors: David R. Douglas, Yorktown, VA (US); Lucas J. P. Ament, New York, NY (US)

(73) Assignees: JEFFERSON SCIENCE ASSOCIATES, LLC, Newport News, VA (US); ASML NETHERLANDS B.V., Veldhoven (NL)

( * ) Notice: Subject to any disclaimer, the term of this patent is extended or adjusted under 35 U.S.C. 154(b) by 0 days.

(21) Appl. No.: 15/051,758

(22) Filed: Feb. 24, 2016

(51) Int. Cl.
*H05H 7/02* (2006.01)
*H05H 7/06* (2006.01)
*H05H 7/22* (2006.01)

(52) U.S. Cl.
CPC ..... *H05H 7/06* (2013.01); *H05H 7/02* (2013.01); *H05H 7/22* (2013.01); *H05H 2007/025* (2013.01)

(58) Field of Classification Search
CPC .. H05H 7/02; H05H 7/12; H05H 7/18; H05H 7/22; H05H 9/00; H05H 9/02; H05H 9/04; H05H 9/045; H05H 2007/122; H05G 2/00; H05G 1/20
USPC ..... 315/500, 501, 505
See application file for complete search history.

(56) References Cited

U.S. PATENT DOCUMENTS

| | | | | |
|---|---|---|---|---|
| 8,384,314 | B2 * | 2/2013 | Treas | H05H 7/02 250/390.1 |
| 9,326,366 | B2 * | 4/2016 | Krasnykh | H05G 2/00 |
| 2016/0147161 | A1 * | 5/2016 | Nikipelov | G02B 1/06 355/67 |
| 2016/0301180 | A1 * | 10/2016 | Nikipelov | H01J 1/34 |

* cited by examiner

*Primary Examiner* — Haissa Philogene

(57) ABSTRACT

A method of controlling e-beam transport where electron bunches with different characteristics travel through the same beam pipe. An RF kicker cavity is added at the beginning of the common transport pipe or at various locations along the common transport path to achieve independent control of different bunch types. RF energy is applied by the kicker cavity kicks some portion of the electron bunches, separating the bunches in phase space to allow independent control via optics, or separating bunches into different beam pipes. The RF kicker cavity is operated at a specific frequency to enable kicking of different types of bunches in different directions. The phase of the cavity is set such that the selected type of bunch passes through the cavity when the RF field is at a node, leaving that type of bunch unaffected. Beam optics may be added downstream of the kicker cavity to cause a further separation in phase space.

9 Claims, 2 Drawing Sheets

Example: 3-pass ERL with bunch frequency equal to the linac frequency

RF KICKER CAVITY TO INCREASE CONTROL IN COMMON TRANSPORT LINES

The United States Government may have certain rights to this invention under Management and Operating Contract No. DE-ACO5-06OR23177 from the Department of Energy.

FIELD OF THE INVENTION

The present invention relates to e-beam transport in particle accelerators and more particularly to particle accelerators in which electron bunches with different characteristics travel through the same beam pipe.

BACKGROUND OF THE INVENTION

Control is difficult in particle accelerators when bunches with different characteristics have to travel through the same beam pipe and see the same optics. Controlling bunches of different types with the same magnets is a challenge. Optimizing the lattice for one type of bunch typically worsens control for the other types of bunches. Unfortunately, no knobs are available that affect only one type of bunch while leaving the others untouched. As an example, in a recirculator energy recovery linacs (ERL) having a single linac, the accelerated and decelerated beams have the same energy and thus cannot be separated by a spreader/recombiner.

As an example, JLAMP (JLab AMPlifier), a 4th generation light source covering the range 10 eV-100 eV in the fundamental mode with harmonics to 1 keV, includes common recirculation transport of accelerated and recovered beams. The common recirculation transport imposes significant constraints on both performance and operability, as multiple beams must be managed using a common set of accelerator components. Common transport is therefore a significant problem in multi-pass ERL designs having a single linac.

Accordingly, what is needed is a method for achieving independent control over the bunch types in common transport lines. As an example, independent control over the bunch types could be used to increase the power of an extreme ultra violet (EUV) free electron laser (FEL), which would be of interest in lithography systems, or in ERL-based light sources such as JLAMP, eRHIC, LHeC, CERN, and KEK.

OBJECT OF THE INVENTION

A first object of the invention is to provide a method for affecting different bunch types in different ways to enable independent control over different bunch types in common ERL transport lines.

A second object of the invention is to provide a method for creating spatial, energy, or temporal separation of different bunch types followed by combined multipole magnets to independently control different bunch types in common transport lines.

A further object of the invention is to provide a kicker cavity to create spatial, temporal, or energy separation of different bunch types so as to direct the bunches types to separate transport channels for independent control, before recombination using the reverse process prior to further transport and acceleration/deceleration.

Another object of the invention is to provide considerable simplification in ERL system architecture by reducing the total amount of beam handling.

A further object of the invention is to improve ERL system architecture by enabling use of shorter linacs and potentially a larger number of passes while avoiding mechanical congestion in beam transport elements.

A further object of the invention is to reduce cost by reducing the total number of SRF components in a beam transport line.

Another object of the invention is to provide a method for independent control of multiple charge particle beams in a common transport system, such as accelerating and recovered beams in many ERLs.

Another object of the invention is to decouple steering control and focusing control of beams in the same transport line.

These and other objects and advantages of the present invention will be better understood by reading the following description along with reference to the drawings.

SUMMARY OF THE INVENTION

The present invention is a method for controlling bunches in a particle accelerator where the bunches include different characteristics and are seeing the same optics. The method includes affecting different bunch types in different ways to enable independent control over the different bunch types. The method includes providing an RF kicker cavity at the beginning of the common transport pipe, and/or at various locations along the common transport path to achieve independent control of different bunch types. For a common transport line the method includes applying RF energy to electron bunches with a kicker cavity by kicking some portion of the bunches, separating bunches in phase space to allow independent control via optics, or separating bunches into different beam pipes. The method includes operating the kicker cavity at a specific frequency to enable kicking of different types of bunches in different directions. Preferably, the operational RF frequency of the kicker cavity is set at a multiple of the frequency with which a selected type of bunch passes the common transport pipe, while avoiding any frequency that is a multiple of the linac RF frequency. The phase of the cavity is set such that the selected type of bunch passes through the cavity when the RF field is at a node, leaving that type of bunch unaffected. The other types of bunches, arriving at a different RF field phase in the kicker cavity, get kicked by the kicker cavity. The kick can be in the transverse directions, but could also be in the longitudinal direction. Operation of the kicker cavity will cause the bunch types to be separated in phase space. The method for controlling bunches may include beam optics added downstream of the kicker cavity to cause a separation in phase space.

DETAILED DESCRIPTION

The present invention is a method for controlling bunches with different characteristics that are travelling through a common beam pipe and seeing the same optics in a particle accelerator. Controlling bunches of different types with the same magnets is a challenge. Optimizing the lattice for one type of bunch typically worsens control for the other types of bunches.

The method includes affecting different bunch types in different ways to enable independent control over different bunch types in common ERL transport lines. The method includes providing an RF kicker cavity at the beginning of the common transport pipe, and/or at various locations along the common transport path to achieve independent control of different bunch types. For a common transport line the method includes applying RF energy to electron bunches with a kicker cavity by a) kicking some portion of the bunches; b) separating bunches in phase space to allow independent control via optics; or c) separating bunches into different beam pipes.

The kicker cavity is operated at a specific frequency that will enable kicking of different types of bunches in different directions.

Figure 1:
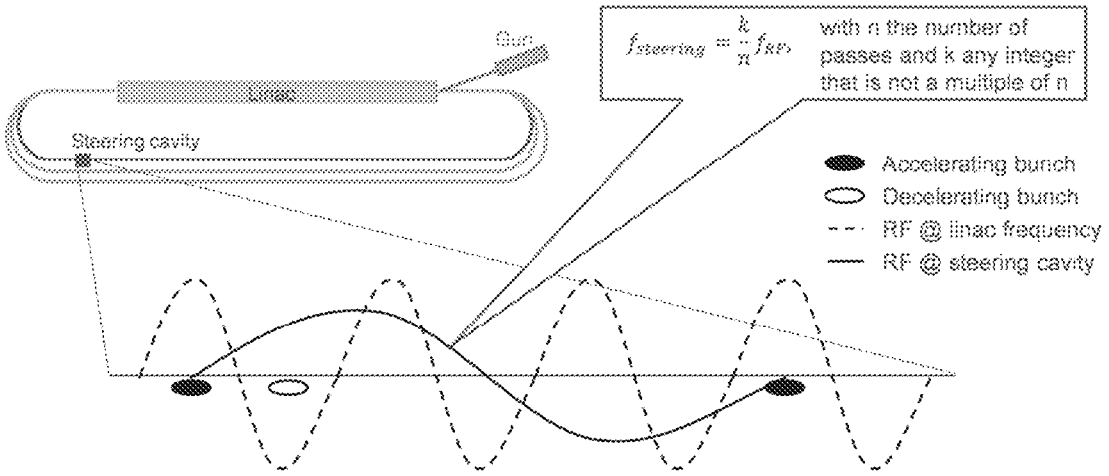
FIG. 1 is a block diagram of a 3-pass ERL with bunch frequency equal to the linac frequency.

As an example, with reference to FIG. 1 below, the operational RF frequency of the kicker cavity is set at a multiple of the frequency with which one selected type of bunch passes the common transport pipe, while avoiding any frequency that is a multiple of the linac RF frequency. The operational RF frequency of the kicker cavity is a steering frequency that is determined by the equation $$f_{steering}=(k/n)f_{RF}$$

wherein n is the number of passes and k is any integer, and $f_{RF}$ is the linac frequency.

The phase of the cavity is set such that the selected type of bunch passes through the cavity when the RF field is at a node, leaving that type of bunch unaffected. The other types of bunches, arriving at a different RF field phase in the kicker cavity, do get kicked by the kicker cavity. The kick can be in the transverse directions, but could also be in the longitudinal direction.

By operating the kicker cavity in the aforementioned manner, the bunch types can be separated in phase space. As an example, when there are two bunch types, one bunch type could go straight while the other bunch type is kicked in the positive x-direction. Other configurations are also possible through appropriate selection of frequency and relative phasing, for example, when all bunches are kicked but in different directions. If the kicks are done on crest, the distortions of the electron bunches are minimized.

Figure 2:
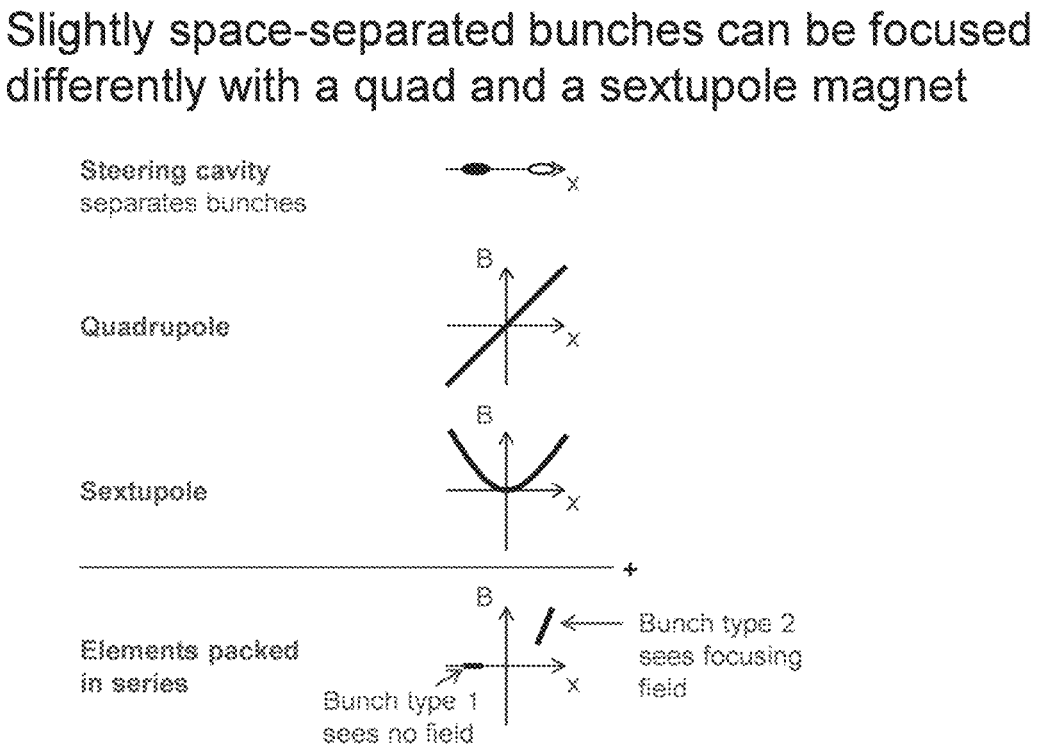
FIG. 2 is a series of plots depicting the focusing of slightly space-separated bunches using a quadrupole and a sextupole closely packed in series to generate a magnetic field that does not affect one bunch type, but does focus the other type.

Beam optics that only affect one region of phase space and not the others can then be added downstream of the kicker cavity to cause a separation in phase space. As an example, with reference to FIG. 2 below, beam optics in the form of a steering cavity is used to separate two bunch types in the x-direction. A quadrupole and a sextupole can then be closely packed in series to generate a magnetic field that does not affect one bunch type, but does focus the other type. Alternately, the separated bunches could be directed to independent transport channels.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A method of controlling electron bunch types having various specific energies in an energy recovered linac (ERL) having a common transport pipe with an upstream end and a downstream end, comprising:

providing a radio frequency (RF) kicker cavity at the upstream end of the common transport pipe;

providing RF energy to the kicker cavity;

selecting electron bunches at a first specific energy to be kicked in energy by the kicker cavity;

setting an operational RF frequency of the kicker cavity at a multiple of the frequency at which the selected electron bunches pass through the common transport pipe; and applying RF energy to the kicker cavity to provide a kick in the energy of the selected electron bunches to separate the selected bunches in phase space from any bunches not at the specific energy of the selected electron bunches.

2. The method of claim 1 wherein the operational RF frequency of the kicker cavity is a steering frequency that is determined by the equation $$f_{steering}=(k/n)f_{RF}$$

wherein n is the number of passes and k is any integer, and $f_{RF}$ is the linac RF frequency.

3. The method of claim 1 wherein the kick is in a transverse direction.

4. The method of claim 1 wherein the kick is in a longitudinal direction.

5. The method of claim 1 wherein the operational RF frequency of the kicker cavity is not a multiple of the linac RF frequency.

6. The method of claim 1 further comprising beam optics downstream of the kicker cavity to affect one region of phase space and not the others.

7. The method of claim 1 further comprising beam optics downstream of the kicker cavity to form a steering cavity for separating two bunch types in a x-direction.

8. The method of claim 7 wherein the steering cavity includes a quadrupole and a sextupole closely packed in series to generate a magnetic field that affects bunch types of a specific energy.

9. The method of claim 1 wherein a phase of the kicker cavity is set to enable the selected electron bunches pass through the cavity when a RF field is at a node, leaving the specific energy of the selected electron bunches unaffected.

* * * * *